US007326842B2

(12) United States Patent
May

(10) Patent No.: US 7,326,842 B2
(45) Date of Patent: Feb. 5, 2008

(54) MONO POSTAL PERCUSSION INSTRUMENT CARRIER

(76) Inventor: Randall L May, 2 Trafalgar, Newport Beach, CA (US) 92660

( * ) Notice: Subject to any disclaimer, the term of this patent is extended or adjusted under 35 U.S.C. 154(b) by 9 days.

(21) Appl. No.: 11/021,596

(22) Filed: Dec. 23, 2004

(65) Prior Publication Data

US 2006/0137506 A1 Jun. 29, 2006

(51) Int. Cl.
*G10D 13/02* (2006.01)

(52) U.S. Cl. ..... 84/421

(58) Field of Classification Search ..... 84/421, 84/411 R; 248/443
See application file for complete search history.

(56) References Cited

U.S. PATENT DOCUMENTS

| | | | | |
|---|---|---|---|---|
| 2,588,830 | A * | 3/1952 | Haanstad | 84/421 |
| 2,854,880 | A * | 10/1958 | Waters | 84/421 |
| 3,405,587 | A * | 10/1968 | Meazzi et al. | 84/421 |
| 4,256,007 | A | 3/1981 | Streit | |
| 4,300,437 | A | 11/1981 | Hinger et al. | |
| 4,387,839 | A | 6/1983 | Dranchak | |
| 4,605,144 | A | 8/1986 | LaFlame | |
| 4,660,455 | A | 4/1987 | Jones et al. | |
| 5,054,357 | A | 10/1991 | Pyle | |
| 5,159,139 | A | 10/1992 | Beals et al. | |
| 5,337,646 | A | 8/1994 | Austin | |
| D354,975 | S | 1/1995 | Penn | |
| 5,419,230 | A | 5/1995 | Ocheltree et al. | |
| 5,573,158 | A * | 11/1996 | Penn | 224/265 |
| 5,949,008 | A | 9/1999 | Augsburger | |
| 5,973,247 | A * | 10/1999 | Matthews | 84/402 |
| 6,028,257 | A * | 2/2000 | May | 84/421 |
| 6,096,955 | A | 8/2000 | Ter Heide | |
| 6,121,528 | A | 9/2000 | May | |
| 6,380,468 | B1 | 4/2002 | Shigenaga | |
| 2004/0194608 | A1 * | 10/2004 | May | 84/421 |

FOREIGN PATENT DOCUMENTS

JP 2006146122 A * 6/2006

* cited by examiner

*Primary Examiner*—Kimberly Lockett
(74) *Attorney, Agent, or Firm*—Buhler & Associates; Kirk A. Buhler

(57) ABSTRACT

A carrier with attachment apparatus that allows mounting of large drums where the playing surface of the drum is vertically oriented. The mounting consists of three or more connection points where one or more of the connection points is adjustable for vertical and or horizontal locating on the drum, and the remaining connection points stabilize the drum on the carrier. The apparatus further includes fasteners for at least one of the connection points that allow rigid locking of the drum to the carrier. The rigid locking can be easily secured and released without tools. The rigid locking fastener consists of a threaded J or eyebolt and a locking nut that captures and clamps the J or eyebolt.

21 Claims, 6 Drawing Sheets

MONO POSTAL PERCUSSION INSTRUMENT CARRIER

FIELD OF THE INVENTION

This invention relates to a shoulder mounted percussion instrument carrier for large drums or bass drums of various sizes. More particularly, the present invention relates to a carrier for large drums where the face of the drum is mounted vertically. The carrier allows the drum to be rigidly mounted in a variety of positions relative to the user. The mounting consists primarily of a three or more point mounting system.

BACKGROUND OF THE INVENTION

The prior art discloses examples of carriers with large bass drum holding drum holding apparatus have been patented and used, but none provide the combination of features disclosed and claimed herein.

Penn U.S. Design Patent No. DES 354,975 issued Jan. 31, 1995 discloses a musical instrument with four retaining points to secure the bass drum onto the carrier. While this patent satisfies the basic requirement of securing the drum onto the carrier, the carrier discloses uses more than three retaining points to secure the drum. When more than three retaining points are used to secure a drum or any object there is the possibility of the points not all being level or even. In addition to the number of mounting points, the carrier has a limited ability to move the drum closer or away from the user. Another limitation with this design is that the attachment of the drum to the carrier is not rigid to allow the drum to be locked into the carrier to reduce or prevent movement of the drum.

LaFlame U.S. Pat. No. 4,605,144 issued Aug. 12, 1986 discloses a carrier with a single connection point to the bass drum. The single connection point allows the drum to be rotated or spun from a horizontal playing orientation to a vertical orientation and back around. This patent also satisfies the basic requirement of securing the drum onto the carrier, but the carrier does not provide rigid attachment of the drum to the carrier. The single connection point does not allow the drum to be oriented in a fixed orientation. In addition, the single mounting point of the drum to the carrier limits the ability to move the drum closer or away from the user.

Other patents such as Pyle U.S. Pat. No. 5,054,357 issued Oct. 8, 1991, Austin U.S. Pat. No. 5,337,646 issued Aug. 16, 1994, Augsburger U.S. Pat. No. 5,949,0008 issued Sep. 7, 1999 and Ter Heide U.S. Pat. No. 6,096,955 issued Aug. 1, 2000 all disclose mounting systems for vertically mounted drums where the drum is not mounted to a carrier. These mounting systems consist of a variety of wheeled holders and suspended holders for bass drums. While these holders allow the bass drum to be held or suspended, none of these patents are for supporting the bass drum on a shoulder-mounted carrier.

Various other configurations such as those currently available from the inventor provide for a three point mounting system for bass drums. In these configurations two top hooks retain the drum and a third fixed bumper reduces some rotational movement of the bass drum when it is attached to the carrier. These configurations also provide the basic function of holding the bass drum on the carrier, but they do not allow for the adjustability of the drum position. They further do not provide a clamping mechanism that allows the bass drum to be locked onto the carrier.

Various prior inventions have been disclosed that attempt to provide large drum muting apparatus for a carrier, but none of the listed inventions provide a three or more point muting system that can be adjusted and or locked into position. The ideal invention would a minimum of three-point mounting or locating, with an adjustment for the position of the drum relative to the carrier and the user. Additionally the drum carrier would allow at least one of the mounting locations to be locked or secured down to prevent movement of the drum on the carrier. The proposed invention provides these features.

BRIEF SUMMARY OF THE INVENTION

One of the objects of the shoulder mounted apparatus is to provide a carrier that allows a user to carry and play a large drum while they transport the drum such as when they are walking, marching or moving. The mounting allows for the drum to be maintained in a vertical orientation where the drumheads are oriented in a vertical configuration allowing the drum to be played by beating the sides of the drum.

Another object of the drum mounting apparatus is to provide a simplified mounting apparatus that requires less than four mounting points to retain the drum. The less than four mounting points allows the drum to be maintained at three points. The three points of mounting allows for a more stable mounting configuration. The three points allows any of the three points to be adjusted independently. The independent adjustment cannot be accomplished using more than three points, because, a plane is defined by three points. While the connection of more than three points can be used, at least one of the connection point will bind when a change is being made to another connection point.

Another object of the invention is the adjustable single post, or mono postal, connection from the carrier to the bass drum that allows the position of the drum to be varied. Raising, lowering, inverting, sliding, rotating or articulating the mono postal component varies the position of the drum on the carrier. These adjustments move or rotate the position of the drum about the remaining connection points of the drum to the carrier.

Another object of the invention is a locking component that allows the connections of the drum to be rigidly secured to the carrier. These components allow quick locking and un-locking of the bass drum to the carrier. The locking components consist of hooks and eye bolts with the addition of a hand-threaded fastener that clamps the hooks and eye bolts together.

Various objects, features, aspects, and advantages of the present invention will become more apparent from the following detailed description of preferred embodiments of the invention, along with the accompanying drawings in which like numerals represent like components.

DETAILED DESCRIPTION OF THE INVENTION

Figure 1:
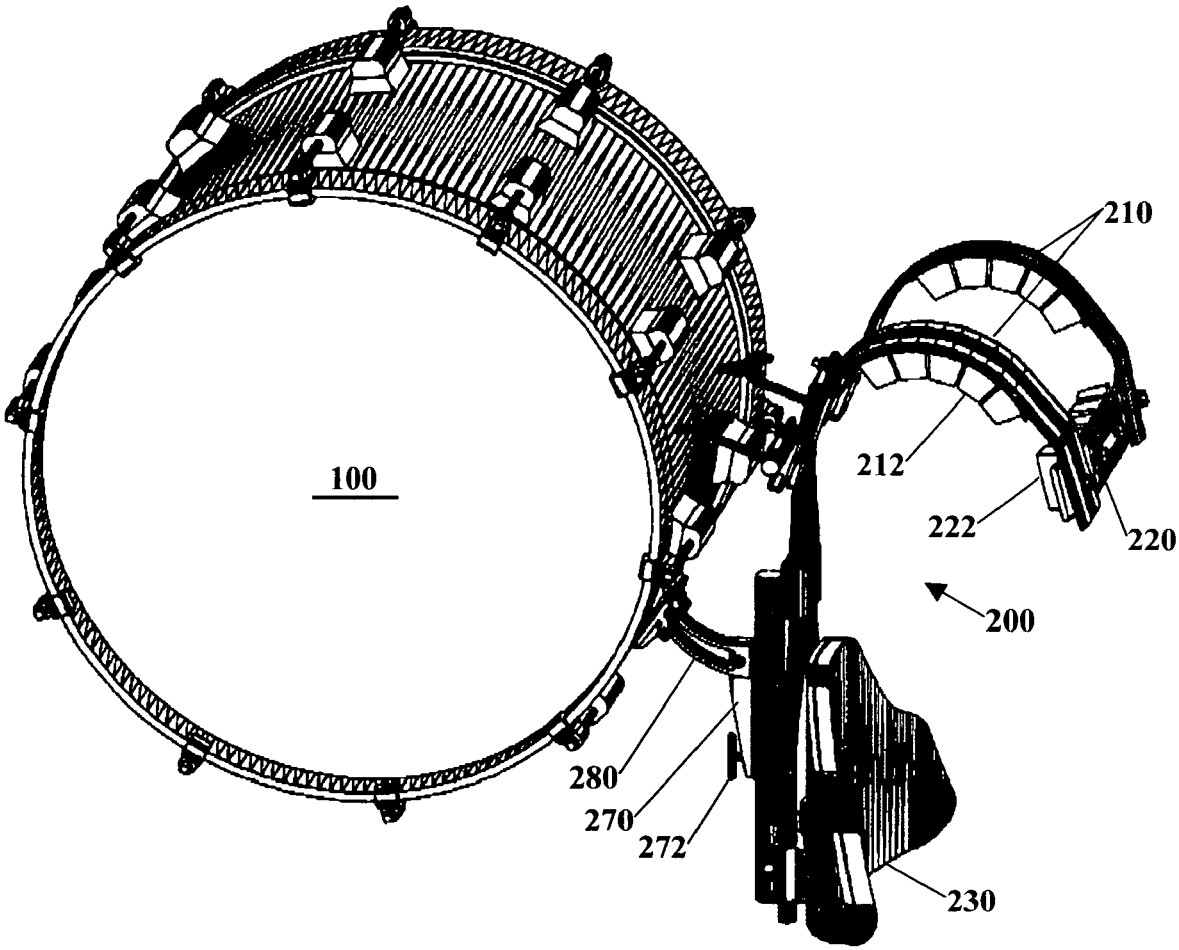
FIG. 1 is an isometric view of the carrier with a bass drum attached.

Referring to FIG. 1, there is shown an isometric view of the carrier with a bass drum attached. From this figure a bass drum 100 is shown attached to a carrier 200. The carrier is shown as a tubular constructed instrument carrier. In the preferred embodiment, the carrier is made in tubular construction, but the carrier can be T-bar, vest, a combination of the types listed or another configuration that is capable of retaining the mounting components to retain a bass drum. The carrier shown consists of shoulder straps 210. The shoulder straps have padding 212 placed in the area that makes contact with the shoulders of the user. The padding provides a cushioning of the shoulder straps to improve the comfort when a person is using the carrier with the bass drum. The shoulder straps can be adjustable or removable to better fit the size of the user. The carrier has a back member 220 attached to the free ends of the carrier. The back member may be adjustable, and or removably attached to the carrier. The back member may also have padding 222 attached to the side of the back member that makes contact with the user. The shoulder straps attach to the front portion of the carrier. The front of the carrier extends down in front of the user and connects to a belly plate 230. The belly plate curves slightly to wrap around the frontal area of the user and provide a greater area contact. The side of the belly plate that makes contact with the user may also be padded to provide comfort to the user. In the area where the shoulder straps connect to the front of the carrier a connection device is located that allows attachment of a bass drum. This is best viewed in FIG. 2 that shows an exploded view of the carrier and the attachment components.

Figure 2:
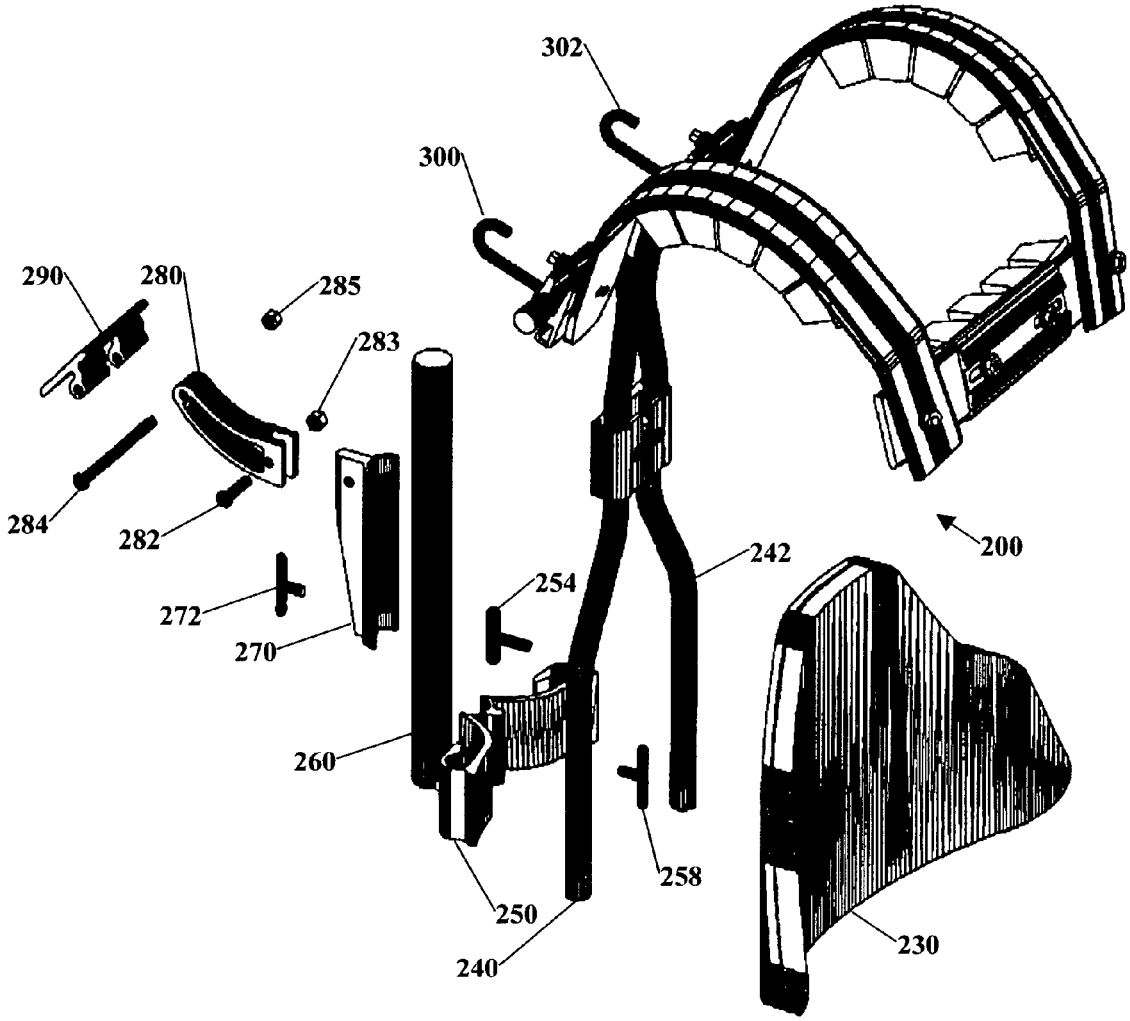
FIG. 2 is an exploded isometric diagram of the carrier with the components of the bass drum carrier shown.
Figure 4:
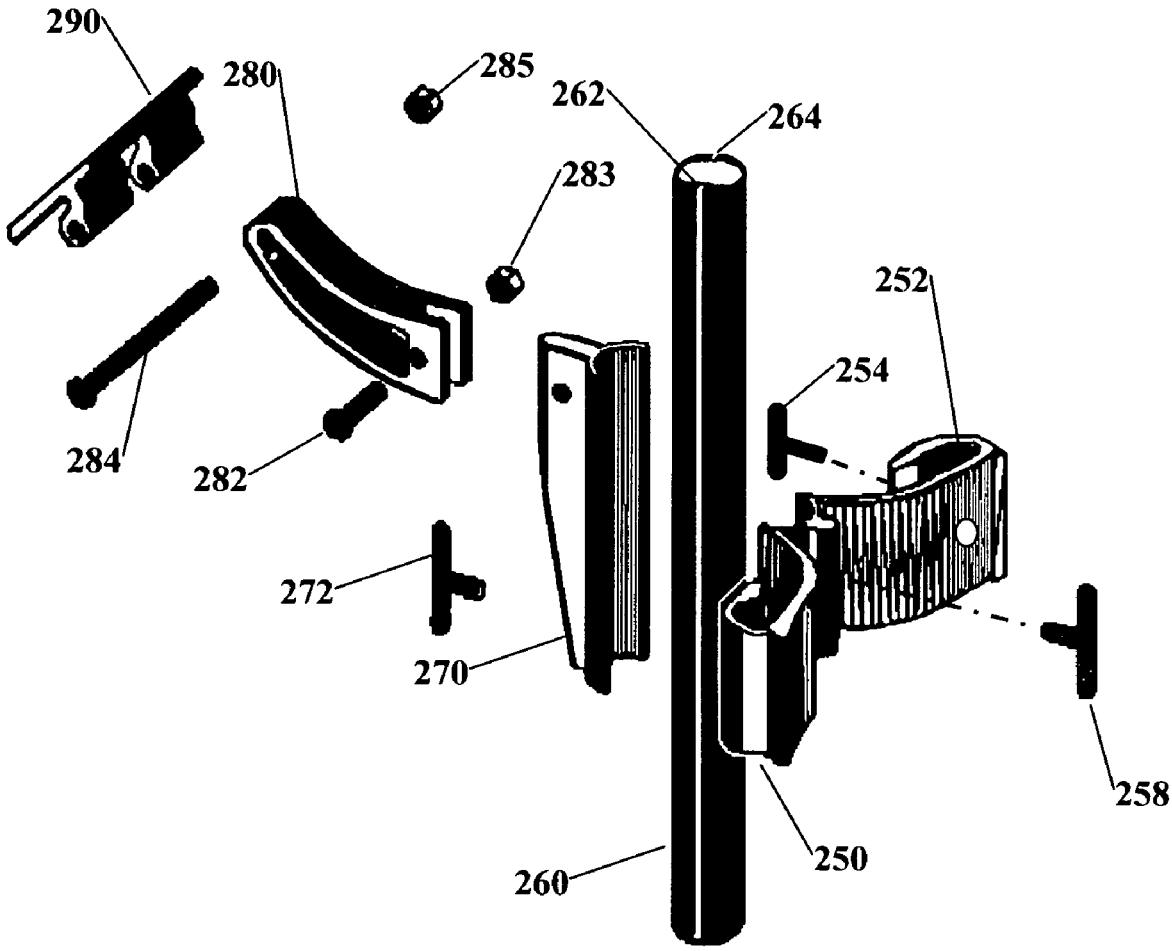
FIG. 4 is an isometric view of the mono postal components.

In FIG. 2 the carrier is shown as a complete assembly with the belly plate 230 not connected to the carrier. The belly plate is shown not attached in this figure to show that the location of the belly plate can be adjusted up or down to accommodate users of different sizes. In the preferred embodiment, at least one attachment mechanism is a J-bolt or a similarly shaped device 300 and 302. The length of the J-bolts can be varied by replacing the J-bolts with longer or shorter J-bolts or by threading the J-bolts into the carrier to different depths. It is further contemplated that J-bolts of different lengths can be used to tip the drum to one side or the other to accommodate the preference of the user. The belly plate can also be replaced with belly plates of different sizes or shapes to accommodate the different sizes of users. In the preferred embodiment the belly plate is attached to the tubular constructed carrier using threaded hardware. The hardware attaches the belly plate through holes or slots locate in the tubes 240, 242 of the vest. If the attachment of the belly plate is with holes, the belly plate is located in finite increments where the holes are located on the tubes. If the attachment of the belly plate is with slots, the belly plate can be loosened on the tubes and slid into an infinite number location to accommodate each user. On the opposite side of the tubes of the carrier a lift base 250 forms a bridge between the tubes 240 and 242 of the carrier. The lift base has two semi-circular openings on each end where the tubes of the vest pass through. Refer to FIG. 4 to see the semi-circular openings where the tubes pass through the lift base. The lift base is attached to the tubes of the vest using a threaded fastener such as item 254 that clamps the lift base onto the tube(s) 240, 242. The lift base can slide on the tubes of the carrier to locate or position the lift base on the carrier.

Figure 3:
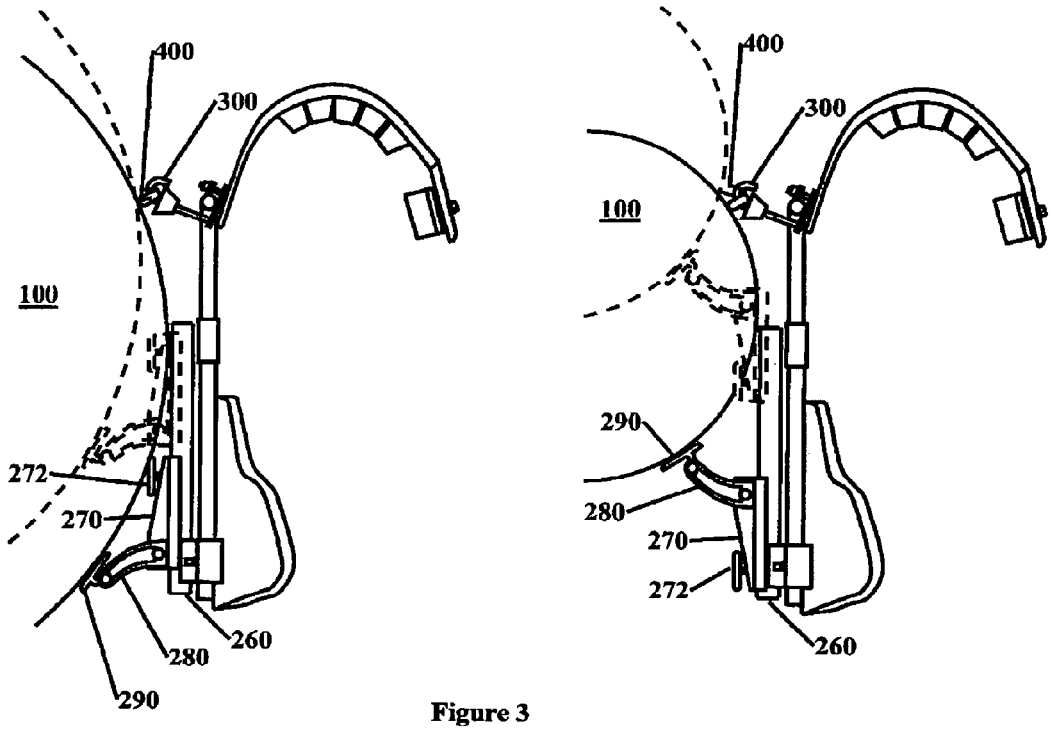
FIG. 3 is a side view of the carrier with a bass drum attached to the carrier.
Figure 5:
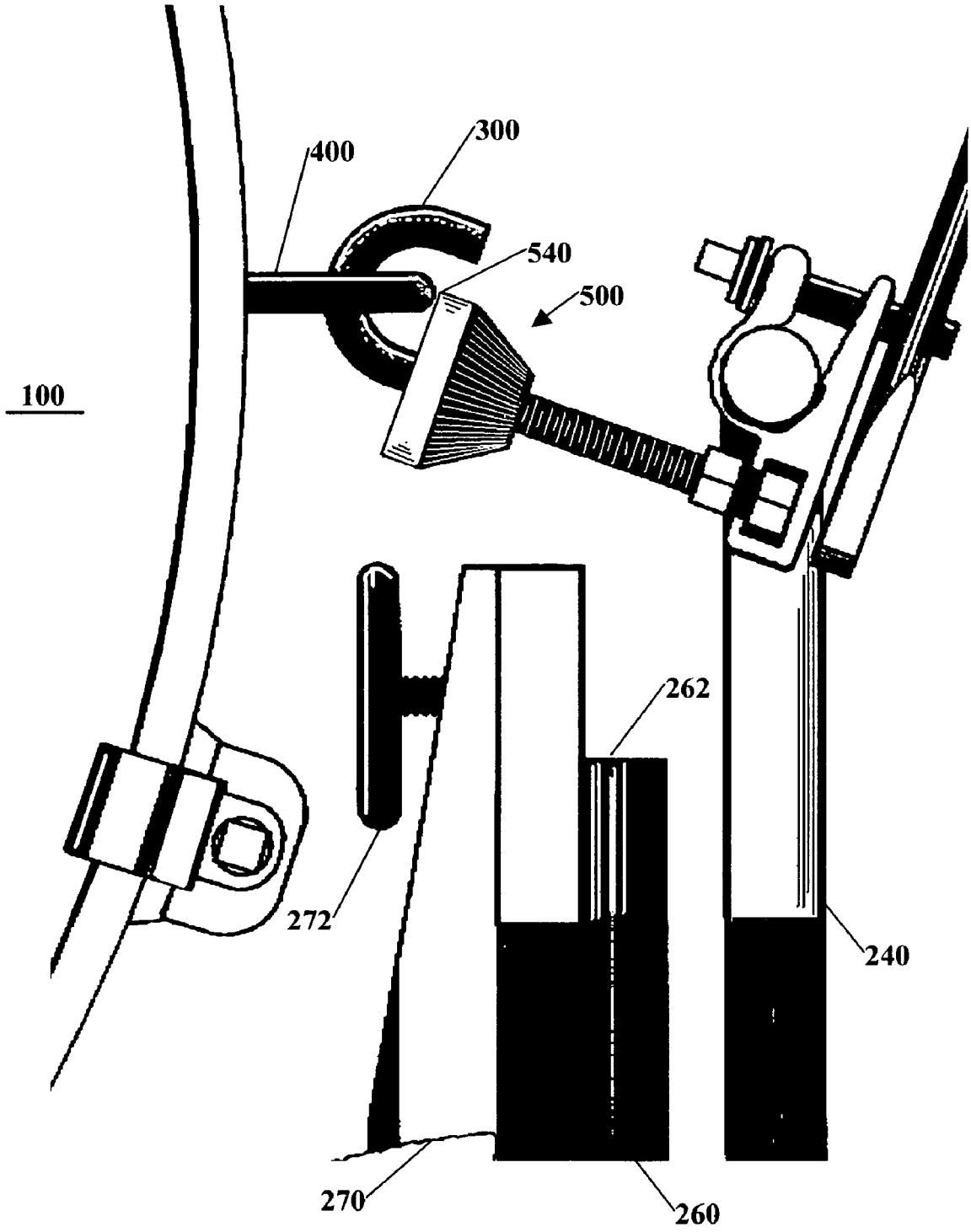
FIG. 5 is an isometric view of the lock down hardware.

A tube 260 slides into the center portion of the lift base. Two slots 262 and 264 run lengthwise down the sides of tube 260. These slots provide a guide and a retaining mechanism for the tube on the lift base. The tube can slide on the lift base, and be locked into position on the lift base with hardware such as item 258. A bass drum support slider 270 is also attached and slides in slots 262 and 264 that exist on the side of tube 260. The bass drum support slider can be moved on tube 260, and locked into a fixed position on tube 260 using hardware 272 or similar hardware. The bass drum support slider can be placed onto the tube 260 in either orientation based upon where the user wants to orient the remainder of the pieced of the bass drum support, and where they want to position the bass drum. FIG. 3 shows a side profile of the bass drum support slider with the narrow portion pointing downward, while FIG. 5 shows the bass drum support slider with the narrow portion pointing upward. A horn shaped member 280 attaches to the bass drum support slider with hardware such as item 282 and 283. This hardware allows the two members to pivot with each other and also be locked into position by tightening the nut 283 on the bolt 282

The horn shaped member 280 is free to rotate on the bass drum support slider. Based upon the location of the bass drum support slider, and the location of the bass drum, the angular relationship between the horn shaped member and the bass drum support slider is established. At the opposite end of the horn shaped member a drum support member 290 is located that provides support to the bass drum. The connection between the horn shaped member and the drum support member is with hardware such as 284 and 285. This hardware allows the two members to pivot with each other and also be locked into position by tightening the nut 285 on the bolt 284

On the flat portion of support member 290 a pad or cushion can be attached to reduce movement and damage to the bass drum 100. This pad cushions the drum if it moves up or down as the user is walking, marching or moving.

The primary function of components 250, 260, 270, 280 and 290 is to provide vertical and horizontal positioning of the bass drum. This positioning allows the bass drum to be moved up, down, closer and further away from the user. This allows the drum to be positioned in various locations for the comfort of the user. These components consist of a single contact point for the drum. The single contact point is one of three points that make contact with and or secure the drum to the carrier. Two remaining contact points are J-bolts 300 and 302.

The J-bolts 300 and 302 connect to eyebolts 410 or similar hardware that connect into the J-bolts. The connection of a J-bolt and an eyebolt is best viewed in FIG. 3 and FIG. 4. The bass drum has the two eyebolts attached through the shell of the bass drum. The bass drum is attached to the J-bolts on the carrier by positioning the eye bolts over the J-bolts, and "hooking" the eyebolts onto the J-bolts. Once hooked together, the drum is rotated down until it comes in contact with the pad on the support member 290. The user can slide and position components 250, 260, 270, 280 and 290 to locate the drum in the playing position that the user prefers. Once the drum position is located, a lock-down component 500, shown in FIG. 5 is used to secure and further lock movement of the drum. The lock down component hand adjusted component.

Figure 6:
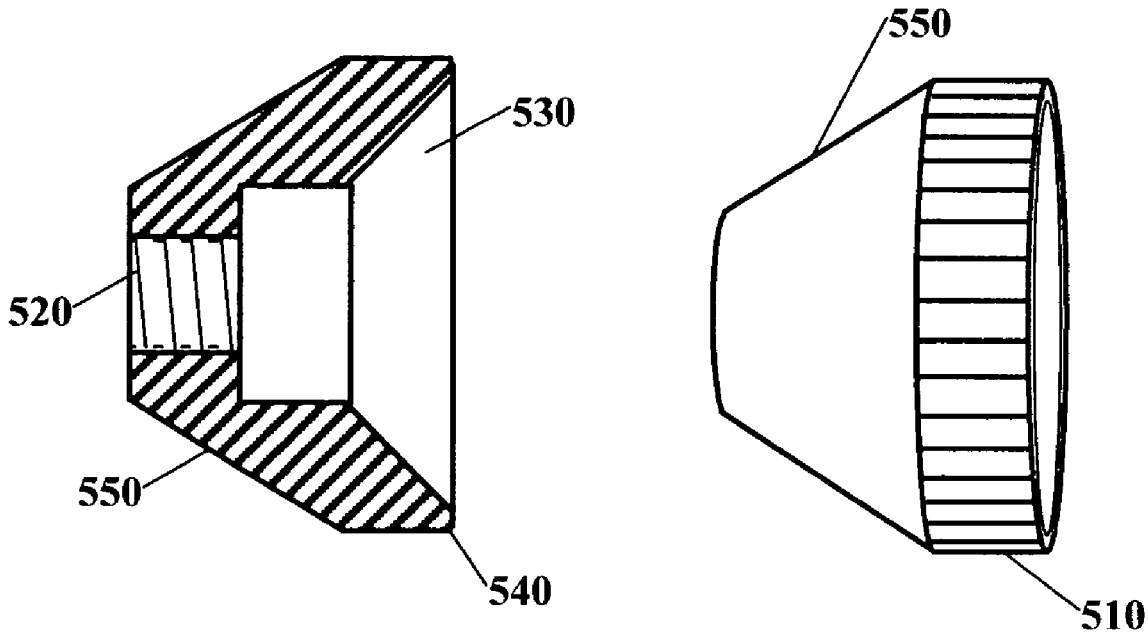
FIG. 6 is a detailed view of the lock down component shown engaged and with the J bolt and the eyebolt.

The lock-down component is shown threaded onto the J-bolt, and locking onto the eyebolt in FIG. 5. A detailed cross section and an outside view of the lock-down component are shown in FIG. 6. From FIG. 6 the threaded area 520 is located on the inside diameter of the part. A recessed area 530 is located on the backside of the part. On the outside diameter of the part, a knurled surface 510 exists to allow the user the grip part more easily, and provide more torque when the part is tightened. A taper 550 also exists on the part to reduce the possibility of damage to the user or other components of the carrier. In the preferred embodiment just the outside diameter is knurled or roughened, but the tapered area may also be textured to give the user a greater gripping area of the lock down component. The outer edge of the lock down member 540 provides the contact point or points where the J-bolt and the eyebolts are clamped. This is best viewed in FIG. 5 where the edge 540 of the lock down component 500 is shown pushing the eyebolt 400 into the J bolt 300. As the J-bolt and the eyebolt are locked into each other motion of the bass drum on the carrier is reduced or eliminated. While a threaded lock down configuration is shown using eyebolts and J-bolts, multiple other mounting and lock down methods can be incorporated including but not limited to sliding locks, spring loaded locks, pinching locks and others. The lock down component can also be a part of the eye bolt and J-bolt where the J-bolt or eye bolt is tapered and as the eye bolt hooks into the J-bolt the J-bolt becomes wider or thicker to reduce movement of the eye bolt.

The main advantage of this three point mounting of the bass drum is that the mounting provides the most secure mounting of the drum without requiring adjustment of a fourth mounting point or location. If a user wants to re-position the drum, the lock down mechanism in unscrewed down the J-bolt to loosen the lock between the eyebolt and the J-bolt. Once the clamp is loose, the drum can be removed or the position of the drum changed by adjusting the single or mono-postal drum support. Once the adjustment is complete the lock down mechanism is screwed back into position. This can all be accomplished without the use of any tools.

Thus, specific embodiments and applications for a three point bass drum mounting system has been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A carrier for vertically mounted drums comprising:

a shoulder supported carrier having a mounting structure that provides at least two rigid mounting components to secure a vertically mounted drum wherein at least one of the at least two rigid mounting components adjustably secures an eye-bolt; and at least one additional component extending between said shoulder supported carrier and said vertically mounted drum that can be positioned on the exterior of the drum to provide vertical and or horizontal positioning of the drum relative to the shoulder supported carrier wherein, the mounting components support the weight of the vertically mounted drum.

2. The carrier for vertically mounted drums from claim 1 wherein the carrier is vest, T-Bar or tubular construction or combination thereof.

3. The shoulder supported carrier from claim 1 wherein the rigid mounting components consist of a user adjustable tightening component.

4. The tightening component from claim 3 wherein the component is threaded.

5. The at least two rigid mounting components from claim 1 wherein the mounting components consist of at least one "J" bolt.

6. The at least one additional component from claim 1 wherein the position of the additional component can be adjusted to position the drum about the at least two rigid mounting component.

7. The at least one additional component from claim 1 wherein the vertical location of the at least one additional component can be adjusted on the carrier.

8. A shoulder supported carrier for supporting vertically mounted drums comprising, a shoulder supported carrier for retaining a vertically mounted drum having at least one vertical shaft or track mounted on the carrier;

at least one rigid appendage extending from the shaft or track to the exterior of the at least one vertically mounted drum at the proximal side of a user where the at least one rigid appendage is linearly movable with or on the at laest one vertical track or shaft to alter the vertical, horizontal and or rotational position of the vertically mounted drum on the carrier.

9. The carrier for vertically mounted drums from claim 8 wherein the carrier is vest, T-Bar or tubular construction or combination thereof.

10. A shoulder supported carrier for supporting vertically mounted drums comprising:

a shoulder supported carrier with at least three points of contact to attach and support the weight of a vertically mounted drum; wherein at least one of the contact points consists of a first retaining hardware that extends through the shell of the drum and attaches through a second retaining hardware mounted on the carrier where the first or second retaining hardware has a lock down component to rigidly bind the first and second retaining hardware to inhibit the vertically mounted drum from free movement on the shoulder-supported carrier.

11. The shoulder supported carrier from claim 10 wherein the lock down component consist of a user adjustable tightening component.

12. The tightening component from claim 11 wherein the lock down component is threaded.

13. The rigid retaining hardware from claim 10 wherein the lock down component consists of at least one threaded component that can be screwed into position to rigidly retain the vertically mounted drum.

14. The carrier for vertically mounted drums from claim 10 wherein the carrier is vest, T-Bar or tubular construction or combination thereof.

15. The at least three points of contact from claim 10 wherein at least one of the contact points consist of a J-bolt.

16. The at least three points of contact from claim 10 wherein at least one of the contact points consist of an eye-bolt.

17. The at least three points of contact from claim 10 wherein at least one of the contact points can be adjusted for horizontal, vertical and or rotational position.

18. The shoulder supported carrier from claim 8 that further includes a pad that is pivotably attached to the end of the appendage where it makes contact with the exterior of the vertically mounted drum.

19. The shoulder supported carrier from claim 8 wherein the appendage and the at least one vertically mounted shaft or track are independently adjustable.

20. The shoulder supported carrier from claim 8 wherein the at least one vertically mounted shaft is movable on the least one vertical shaft mount on the carrier.

21. The shoulder supported carrier from claim 8 wherein the at least one vertically mounted shaft is splined for securing and tracking on the carrier and with the at least one appendage.

* * * * *